US006123371A

United States Patent [19]

Fisher

[11] Patent Number: 6,123,371

[45] Date of Patent: Sep. 26, 2000

[54] VEHICLE DOOR LOCK ACTUATOR

[75] Inventor: Sidney Fisher, Solihull, United Kingdom

[73] Assignee: Meritor Light Vehicle Systems, United Kingdom

[21] Appl. No.: 09/077,560

[22] PCT Filed: Sep. 20, 1996

[86] PCT No.: PCT/GB96/02295

§ 371 Date: Nov. 23, 1998

§ 102(e) Date: Nov. 23, 1998

[87] PCT Pub. No.: WO97/20123

PCT Pub. Date: Jun. 5, 1997

[30] Foreign Application Priority Data

Nov. 24, 1995 [GB] United Kingdom ..... 9524083

[51] Int. Cl.[7] ..... E05C 3/06

[52] U.S. Cl. ..... 292/216; 292/201; 292/DIG. 23

[58] Field of Search ..... 292/169.11, 201, 292/216, DIG. 23, DIG. 3; 20/264, 277

[56] References Cited

U.S. PATENT DOCUMENTS

| | | | |
|---|---|---|---|
| 4,334,704 | 6/1982 | Yamada | 292/216 |
| 4,492,395 | 1/1985 | Yamada | 292/216 |
| 4,978,154 | 12/1990 | Kleefeldt | 292/201 |
| 5,069,491 | 12/1991 | Weinerman | 292/48 |
| 5,538,298 | 7/1996 | Ikeda | 292/201 |

FOREIGN PATENT DOCUMENTS

| | | | |
|---|---|---|---|
| 2073299 | 3/1980 | United Kingdom | E05B 65/12 |
| 95/00005 | 1/1995 | WIPO | E05B 65/20 |

*Primary Examiner*—B. Dayoan
*Assistant Examiner*—Gary Estremsky
*Attorney, Agent, or Firm*—Jenkens & Gilchrist, A Professional Corporation

[57] ABSTRACT

A lock actuator mechanism for vehicle doors, especially rear passenger doors has a child safety facility and provision for locking the door even if powered actuation is inoperative. A main power driven locking lever rocks between its locked and unlocked condition with respect to a T-shaped driven output lever, one arm of which has a longitudinal slot. Co-axial with the T-shaped driven output lever is a drive input lever operated by the interior door handle and having an L-shaped slot. A drive dog pin is received in both slots and linked to a security actuator lever co-axial with the main power driven locking lever. The security actuator lever can be shifted by a button accessible only when the door is open and can be set to shift the dog pin into the lateral part of L-shaped slot disabling the interior door handle for child safety. The security actuator lever can also be used to set the lock manually if power should fail by drive engagement of a pin thereon with a slot in the main, power driven, locking lever.

4 Claims, 2 Drawing Sheets

VEHICLE DOOR LOCK ACTUATOR

Figure 1:
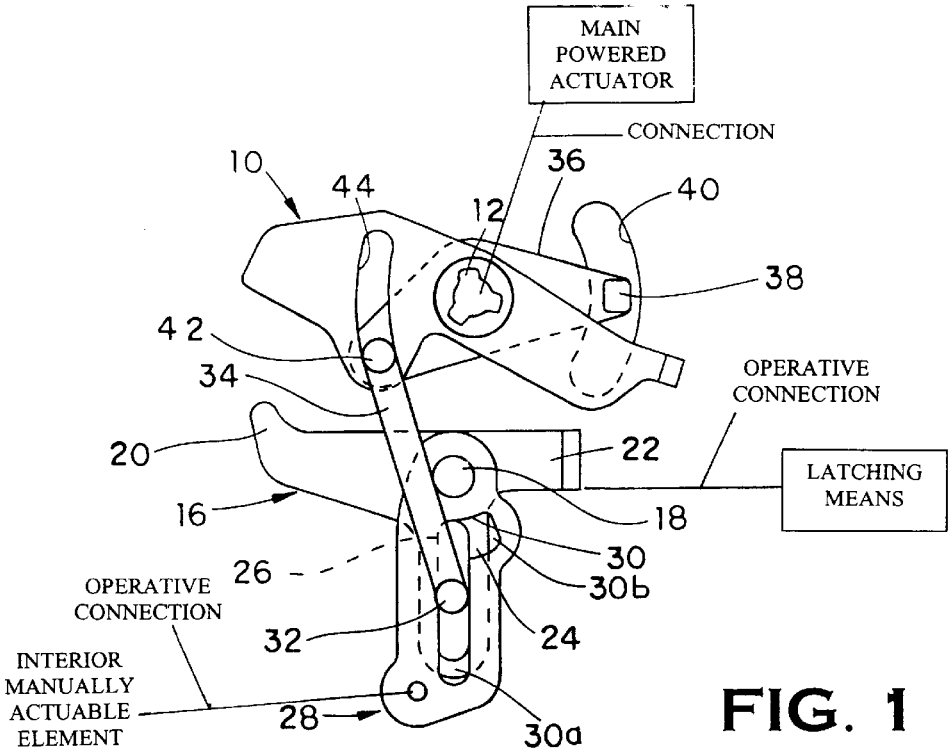

This invention relates to lock actuator mechanism for doors and other closures of vehicles. It has particular application to actuator mechanisms forming part of locking systems of the kind in which the individual locks are power operable and interconnected through a central control unit for electrical actuation whereby locking or unlocking of all doors can be effected from a single control station operable from within or outside the vehicle, herein referred to as "central locking systems".

The object of the invention is to provide actuator mechanism incorporating a child safety facility which is convenient and reliable in operation, of simple and durable construction, which can readily be provided by modification of existing patterns of latch and locking assemblies, and which enables the respective door to be secured even if powered operation should break down or fail.

According to the invention there is provided vehicle door lock actuator mechanism including (a) a housing or other mounting formation;

(b) a drive input lever fulcrummed on said formation and having operative connection to an interior manually actuable element (e.g. an interior door handle) selectively operable to shift said lever about its fulcrum axis between first and second angular positions;

(c) a driven output lever having operative connection with latching means whereby displacement of the output lever from a first to a second angular position releases the door from a latched condition in use;

(d) coupling means comprising a drive dog having connection with one of said levers so that it is positively displaced on angular movement thereof and engaging a drive formation of the other of said levers extending longitudinally of an arm thereof and having a portion shaped to permit relative movement between the dog and said arm laterally of the latter;

(e) a security actuator linked to the drive dog and selectively movable between first and second positions to shift the dog longitudinally of said lever arm between an engaged condition respective to the first position at which the dog couples the levers for angular movement in unison, and a lost motion child safety condition respective to the second position at which the dog is aligned with said portion so that angular movement of the input lever between its first and second positions is not transmitted to the output lever for releasing the latch, said actuator being manually operable by means rendered inaccessible by the closing of the door;

(f) a main locking lever or other main locking element selectively driven by a main power actuator between a locked condition at which the associated latch is secured against release and an unlocked position freeing the latch for release; and (g) a lost motion connection between the security actuator and the main locking element permitting operation of the locking element without affecting the setting of the security actuator to its said first and second positions, but movement of that actuator to a third position carrying the locking element to the locked condition whereby the mechanism can be set to lock the door on closing for securing the vehicle without operation of the power actuator.

Conveniently the output lever is fulcrummed on the mounting formation co-axially with the input lever and an arm of the output lever is in substantially face to face relationship with an arm of the input lever when both levers are at the same angular position, the drive dog engaging drive formations extending longitudinally of both arms and being shifted therealong by the security actuator.

The security actuator and the main locking element may both be levers and may be fulcrummed co-axially, the drive dog being carried on a link pivotally connected to an arm of the security actuator lever and said lost motion connection including a pin carried by the actuator lever arm co-acting in an arcuate slot in an arm of the locking lever.

Said actuator lever will be operatively enclosed in the door structure except for an operating button or other formation exposed in or on a surface part of the door which is accessible for manual engagement only when the door is open.

Figure 2:
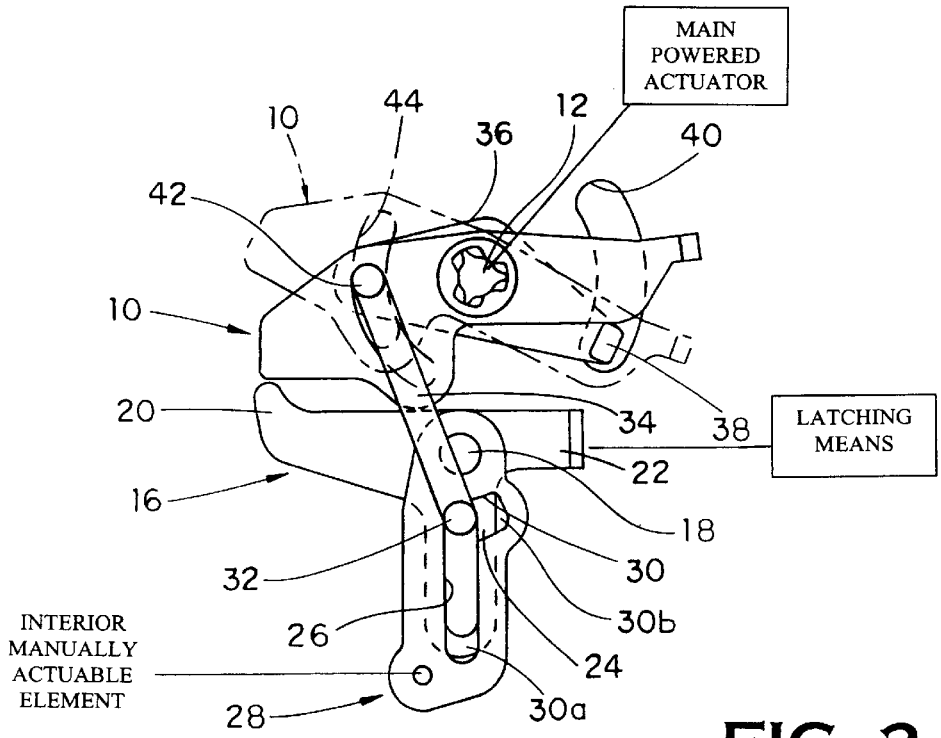
Figure 3:
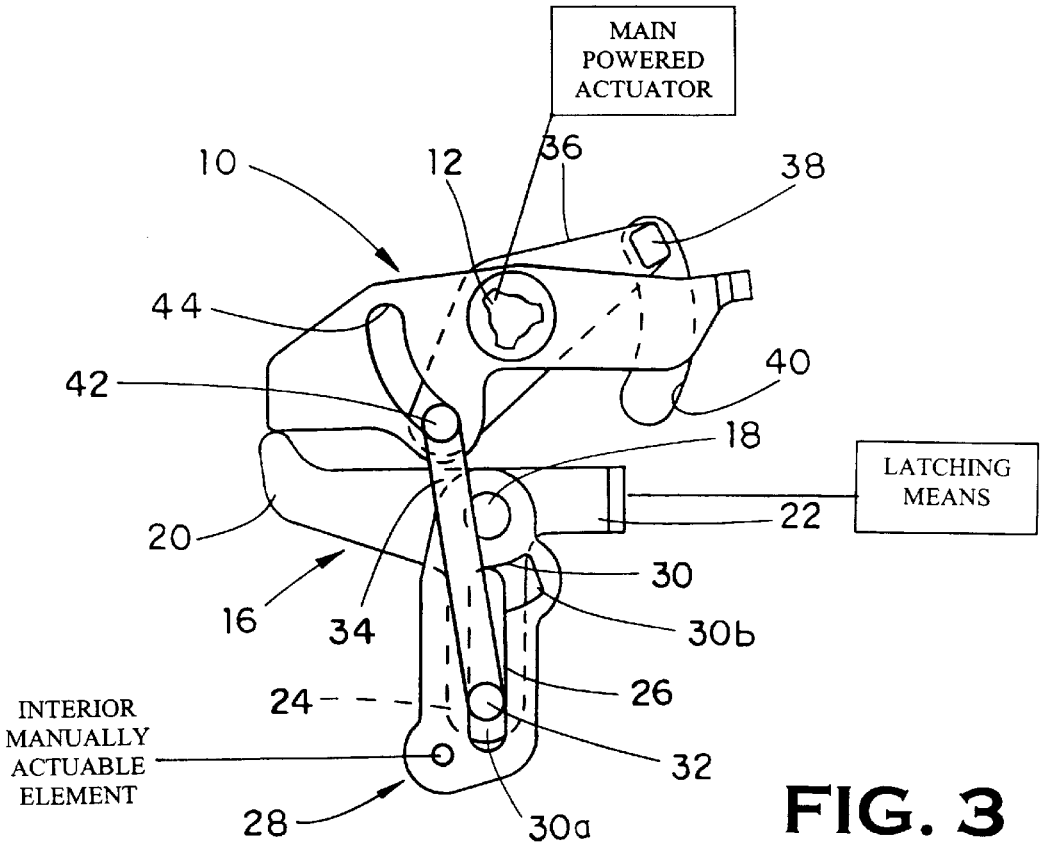
Figure 4:
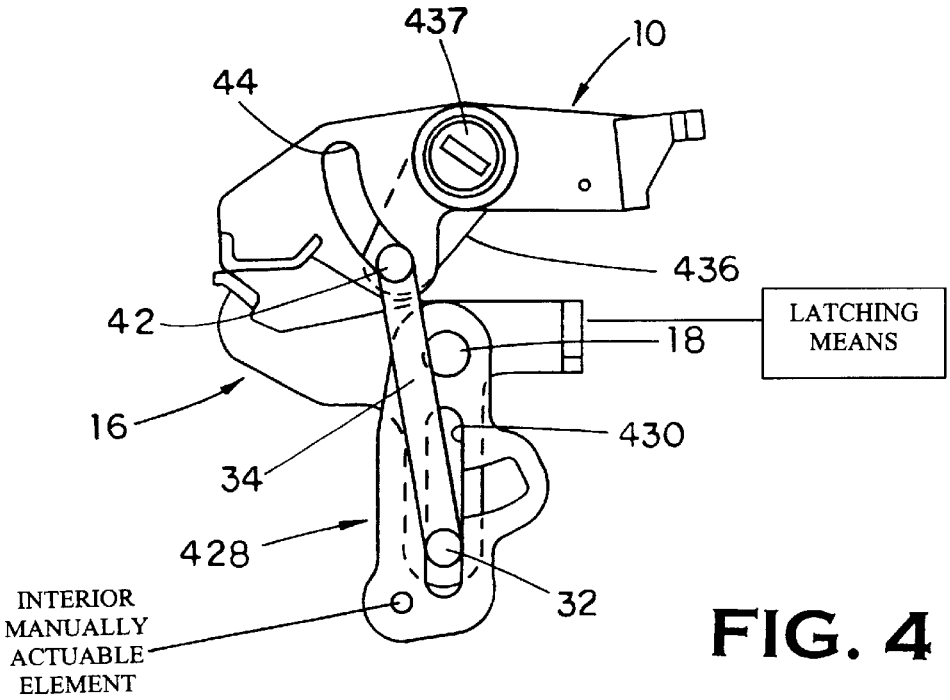

An example of the invention is now more particularly described with reference to the accompanying drawings wherein:

FIG. 1 a side elevation of components of a lock actuator mechanism;

FIGS. 2 and 3 are elevations of said components showing them in respective different operating positions, and FIG. 4 is a like elevation of a modified form of said components.

The mechanism described will be incorporated into a vehicle door latch and locking assembly of known kind having remotely controlled power operation as part of a central locking system of the vehicle. Only such parts of the latching and locking mechanisms of the assembly as are necessary to the understanding of these examples of the invention are here described and shown in the drawings.

The assembly will include latching means (not shown) releasably retaining the door at the closed position, the latching means being released for opening the door by the operation of interior or exterior door handles (not shown). The door concerned will typically be a rear passenger door of the vehicle, the rear seats being commonly occupied by children who are there often remote from adult supervision.

Said assembly includes a mounting formation (not shown) locating its various components and constructed to form a housing on and within the structure of the respective door in use substantially containing and protecting them both from ingress of dirt and from any unauthorised probing or other access with a view to tampering with the mechanism.

Referring now to FIGS. 1–3 of the drawings said assembly includes lock actuator mechanism having a main locking lever 10 secured on a drive shaft 12 of a main powered actuator (not shown) incorporating ail electric drive motor. This actuator is selectively operated from the central system to shift lever 10 angularly between a locked position shown in FIG. 3 with its arms generally horizontal, and an unlocked position shown in FIG. 1 rotated clockwise by about 300 from the locked position. Lever 10 is connected for actuation of the locking mechanism of the assembly in known manner.

A generally T-shaped drive output lever 16 is fulcrummed on a fixed pivot 13 spaced below locking lever 10 as viewed in the drawings and has a pair of generally horizontal arms 20, 22 and a third generally vertical arm 24 extending downwards from its fulcrum.

Arm 24 includes a longitudinal drive formation in the form of a parallel sided slot 26.

Fulcrummed co-axially with lever 16 on pivot 18 is a drive input lever 28 extending generally vertically from pivot 18 so that its major part is in face to face relationship with slotted arm 24. The distal end of lever 28 is connected to the interior door handle, actuation of the latter causing angular displacement of lever 28 through a linkage (not shown).

Lever 28 also includes a drive formation in the form of an inverted L-shaped slot 30 having a vertical lower limb 30*a* co-incident with the lower part of slot 26 in arm 24 when levers 16 and 28 are at the same angular position, and a generally horizontal limb 30*b* forming an upper slot portion which extends laterally to the right as viewed in the drawings.

A headed pin forms a drive dog 32 which is engaged through both lever slots 26 and 30. Dog 32 is carried on the lower end of a link 34., its upper end being pivotally connected to the distal end of one arm of a security actuator lever 36. Lever 36 is fulcrummed co-axially of lever 10 but can move angularly independently of drive shaft 12.

The other arm of lever 36 has an operating button 38 at its distal end which is accessible for manual operation through an arcuate slot 40 in the door casing or other door structure. Lever 36, and indeed the remainder of the above mechanism is otherwise enclosed in or on the assembled door against access. Slot 40 is covered and inaccessible when the door is closed.

With the door open security lever 36 can be moved using button 38 between a first position mid way along slot 40 shown in FIG. 1 and a second or child safety position to the bottom of slot 40 shown in FIG. 2. In the latter position dog 32 is shifted upwardly to co-act with the upper portions of slots 26 and 30. In this position the horizontal limb 30*b* of slot 30 permits angular movement of drive input lever 28 without any motion being transmitted to output lever 16, thus rendering the interior door handle inoperative by disabling its drive connection to the latch mechanism.

This child safety condition prevents the door being opened from the inside. In this particular application there is no sill button or other manually operable element on the inside of the door for locking or unlocking the related assembly, this can only be effected by powered operation with the door closed.

To restore operation of the inside door handle the door must be opened from the outside, lever 36 can then be set to the first position (FIG. 1) and this shifts dog 32 down slots 30 and 26, linking levers 20 and 16 for movement in unison. Normally powered operation will suffice for all operating conditions; the central locking system enables locking and unlocking of some or all of the vehicle doors from the outside, typically by a hand-held remote control device of known kind emitting a coded infra-red or ultrasonic signal to a pick-up on the vehicle body usually associated with the driver's or other front doors. The central system ensures that all the doors and/or other closures are secured with corresponding cancellation unlocking the mechanism when a door is to be opened.

Failure of the central locking system might occur, most commonly due to the vehicle being left parked and locked and the battery going flat (e.g. if lights have inadvertently been left switched on) or, more rarely, due to failure or malfunctioning of electrical components of the system. Hence provision is made for at least one door on the vehicle to be unlocked and locked manually in such emergency, independently of its power actuation, from the vehicle exterior as by providing a conventional key-operated lock cylinder on a front door.

Absence of power actuation may occur with some or all non-key operated locks in an unlocked condition. So that all the doors can be secured, e.g. so that the vehicle can be safely left unattended while getting assistance the mechanism further includes means for effecting manual locking.

Said means comprises a pin 42 at the distal end of the left hand arm of lever 36, conveniently also serving as the pivotal connection of link 34 therewith. Pin 42 projects into an arcuate slot 44 in lever 10 .

Slot 44 provides lost motion connection between levers 10 and 36 so that drive dog 32 is not displaced from the selected position by the powered locking and unlocking movement of lever 10. If the power has failed with the door unlocked it can be opened. Using button 38 lever 36 can then be shifted to a third position shown in FIG. 3, to the top of slot 40. This engages pin 42 with the bottom of lever slot 44 driving lever 10 to the locked position. The door can then be slammed shut while set locked so that it cannot be opened from outside.

FIG. 4 illustrates a modified construction. Security actuator lever 436 is single armed and instead the operating button 30 of lever 36 is provided with a boss 437 having a cross groove for engagement by a coin, the end of a key, or the like for manual operation through an aligned hole in the door casing or other structure, accessible only when the door is open.

The form of the drive input lever 428 is also different, its drive formation slot 430 is shaped as a T turned on its side so that there is a lateral extension mid way along its length. The other components of the FIG. 4 mechanism are as previously described and operate in the same way, except that the child safety condition is provided when dog 32 is mid way of slot 430, and is cancelled making the inside door handle operative when it is at either end of that slot.

It will be understood that the drive formation which includes a portion shaped to permit relative lateral movement between the drive dog and the related lever arm could be provided in the arm of the output lever 16, while the arm of the input lever 28 has a simple longitudinally extending slot or other drive formation.

What is claimed is:

1. A vehicle door lock actuator mechanism comprising:

a. a mounting formation;

b. a driven input lever fulcrumed on said mounting formation for operative connection to a manually actuable element inside the vehicle door selectively operable to shift said driven input lever about its fulcrumed axis between a first and a second angular position;

c. a driven output lever for operative connection with latching means whereby displacement of said driven output lever from a first to a second angular position releases the vehicle door from a latched condition in use;

further characterized in that said vehicle door lock actuator mechanism includes:

d. coupling means including a drive dog having connection with one of said driven input lever or said driven output lever so that said coupling means is positively displaced on angular movement thereof and engaging a drive formation of the other of said levers extending longitudinally of an arm thereof and having a portion shaped to permit relative movement between said drive dog and said arm laterally of said drive dog;

e. a security actuator lever linked to said drive dog and selectively movable between a first and a second position to shift said drive dog longitudinally between an engaged condition with respect to the first position at which said drive dog couples the levers for angular movement in unison, and a loss motion child safety condition respective to said second position at which said drive dog is aligned with said second position so that angular movement of said driven input lever between the first and the second position is not transmitted to said driven output lever for releasing said latching means, said security actuator lever being manually operable by means rendered inaccessible by the closing of the vehicle door;

f. a main locking element selectively driven by a main power actuator between a locked condition and an unlocked condition wherein the associated latch means is secured against release in the locked condition and is freed for release in the unlocked condition; and g. a lost motion connection between said security actuator lever and said main locking element defining means for permitting motion of said main locking element without affecting the setting of said security actuator lever to the first and the second position, and for permitting movement of said security actuator to a third position carrying said main locking element to the locked condition;

whereby said vehicle door lock actuator mechanism can be set to lock the vehicle door on closing for securing the vehicle without operation of said power actuator.

2. The mechanism as defined in claim 1 wherein said driven output lever is fulcrumed on the mounting formation co-axially with said driven input lever and the arm of said driven output lever or said driven input lever is in substantially face-to-face relationship with an arm of the other of said driven output lever or driven input lever when both levers are at the same angular position, said drive dog engaging drive formations extending longitudinally of both arms and being shifted there along by said security actuator.

3. The mechanism as defined in claim 1 wherein said security actuator lever and said main locking element are both levers and are fulcrumed co-axially, said drive dog being carried on a link pivotally connected to an arm of said security actuator lever and said loss motion connection including a pin carried by the actuator lever arm co-acting in an arcuate slot in an arm of said main locking element.

4. The mechanism as defined in claim 1 wherein said security actuator and said main locking element are both levers and are fulcrumed co-axially, said drive dog being carried on a link pivotally connected to an arm of said security actuator lever and said lost motion connection including a pin carried by the actuator lever arm co-acting in an arcuate slot in an arm of said main locking element.

* * * * *